United States Patent [19]

Matej

[11] 3,930,392

[45] Jan. 6, 1976

[54] STRAIGHTENING MACHINE

[75] Inventor: Ronald J. Matej, Parma, Ohio

[73] Assignee: Prutton Corporation, Cleveland, Ohio

[22] Filed: Mar. 21, 1975

[21] Appl. No.: 569,889

[52] U.S. Cl. ..... 72/92
[51] Int. Cl.[2] ..... B21D 3/02
[58] Field of Search ..... 72/92, 91, 93

[56] References Cited

UNITED STATES PATENTS

| | | | |
|---|---|---|---|
| 1,109,662 | 9/1914 | Cavanagh, Jr. | 72/92 |
| 2,550,842 | 5/1951 | McClure et al. | 72/92 |
| 2,860,686 | 11/1958 | Frank et al. | 72/92 |

*Primary Examiner*—Milton S. Mehr
*Attorney, Agent, or Firm*—Louis V. Granger

[57] ABSTRACT

A machine is provided to straighten both the stem and the head of flanged stem workpieces such as poppet valves by rolling the stem of the workpiece between a rotary die and an arcuate stationary die. The flange of the workpiece being larger than the stem overlaps the rotary second die to have a first path of a contact portion of the flange. A straightening roller is journalled for orbiting movement on a rotary straightening member and the straightening roller has a contact area movable in a second path intersecting the first path to engage the flange and bend the workpiece cyclically. This bending effects a straightening of such flange. The above description is merely one form of the invention and is not to be construed as limiting on the scope of the invention.

18 Claims, 11 Drawing Figures

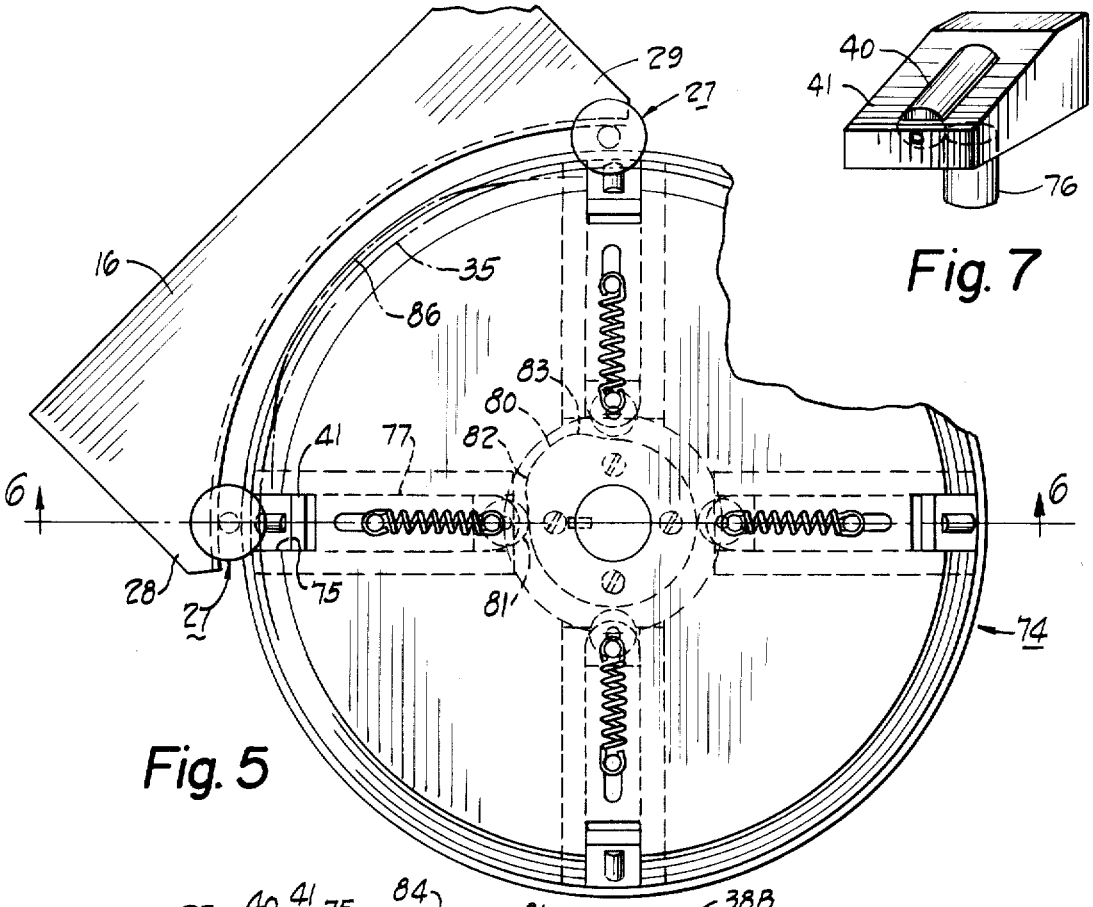
Fig. 5
Fig. 7
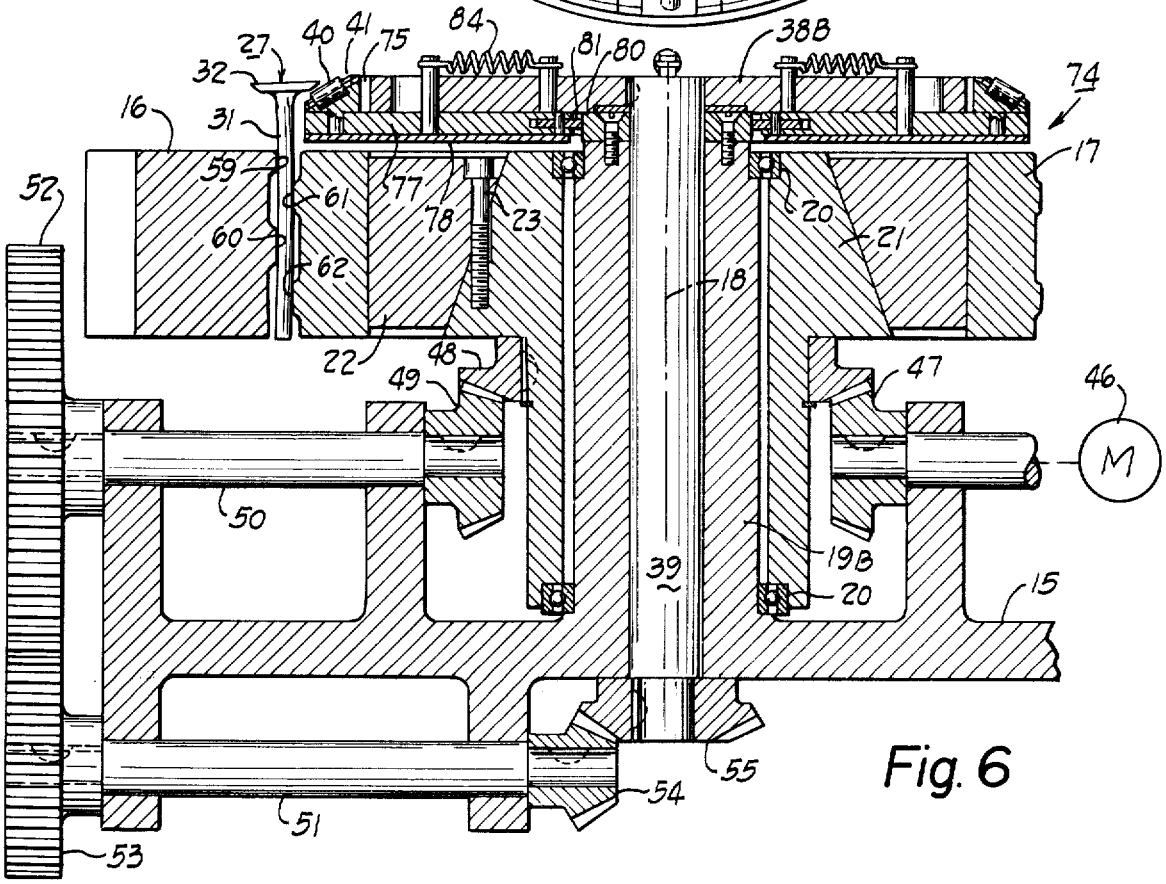
Fig. 6

STRAIGHTENING MACHINE

BACKGROUND OF THE INVENTION

Straightening machines have been proposed including those operating on a planetary principle. One straightening machine for poppet valves included two rotary dies of similar diameter with spaced axes and slightly different peripheral speeds engaging the stem of the poppet valve so that the workpiece passed between the nip of the die rollers. One die roller had a straightening disc freely journalled coaxially thereon to engage the underside of the head of the poppet valve as the valve gradually passed through the nip. Any wobble to the head of the poppet valve was removed by engagement with the free running straightening disc. Such prior art machine had the difficulty of not being able to satisfactorily control the attitude of the workpiece because of the limited area of contact of the workpiece stem with the two separated roller dies, both of which have convex faces. The poppet valve stem would easily become cocked at an angle other than parallel to the two roller dies, especially because of the unbalanced force caused by the straightening disc cyclically engaging the poppet valve head. The problem to be solved then is how to establish a flanged stem workpiece straightening machine to overcome this deficiency.

An object of the invention is to provide a straightening machine for flanged stem workpieces wherein the workpiece is securely held during travel through the machine.

Another object of the invention is to provide a straightening machine wherein a flange of a stemmed workpiece is cyclically bent more and more to a midpoint of a die and is then bent in decreasing amounts until the flange is straight, namely, perpendicular to the stem.

Another object of the invention is to provide a straightening machine wherein the flange of the stemmed workpiece moves in a first path and a straightening roller moves in a second path intersecting the first path so as to engage and bend the workpiece.

Another object of the invention is to provide a straightening machine wherein the phase position of a straightening roller relative to a workpiece flange is gradually changed so that the straightening roller engages and straightens the workpiece flange.

Other objects and a fuller understanding of this invention may be had by referring to the following description and claims, taken in conjunction with the accompanying drawings, in which:

BRIEF DESCRIPTION OF THE DRAWING

FIG. 5 is a plan view of a further modification of the invention;

FIG. 6 is a sectional view on line 6—6 of FIG. 5;

FIG. 7 is an isometric view of a straightening roller block;

DESCRIPTION OF THE PREFERRED EMBODIMENTS

Figure 1:
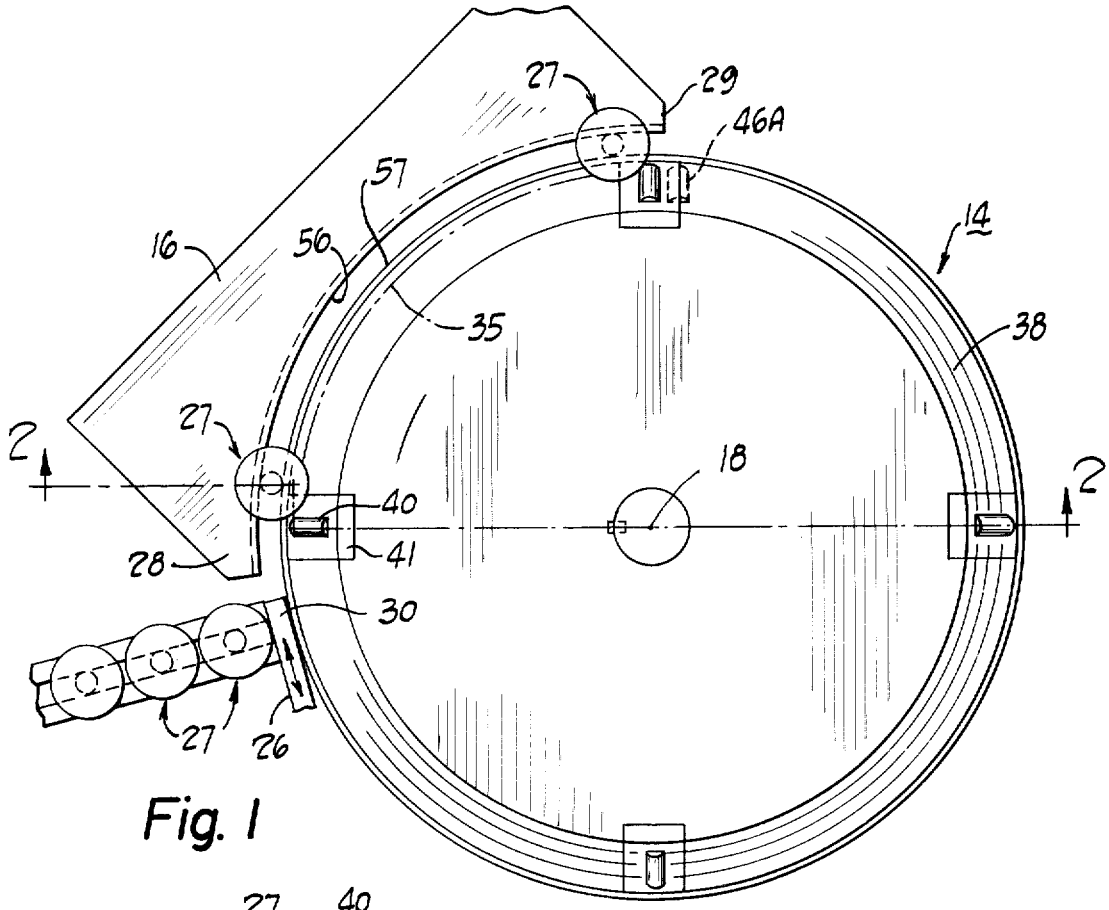
FIG. 1 is a partial plan view of a straightening machine made in accordance with the invention.
Figure 2:
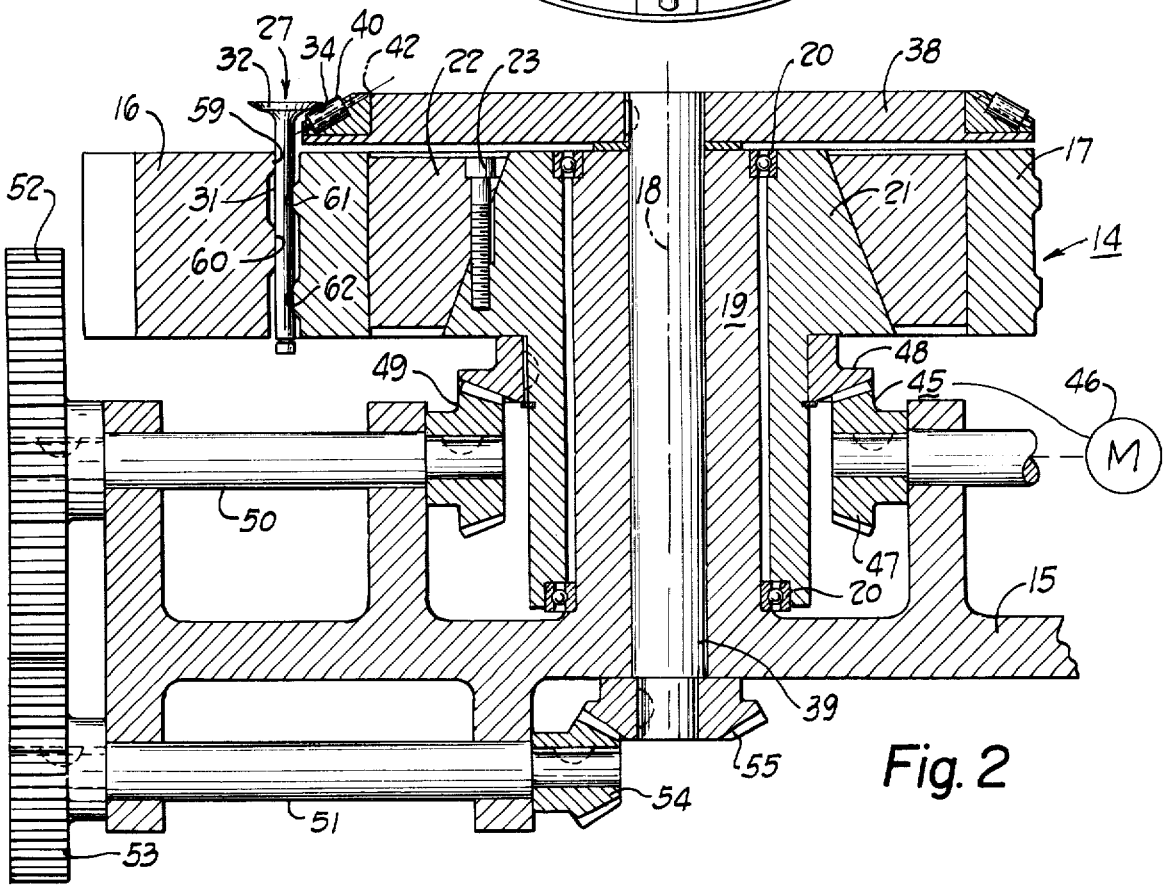
FIG. 2 is a sectional view on line 2—2 of FIG. 1.

FIGS. 1 and 2 illustrate a straightening machine 14 embodying the invention. This straightening machine has a base 15 with an arcuate first die 16 fixed on the base by any suitable means, not shown. A rotary second die 17 is journalled for rotation on the base on a first axis 18. This journalling may take one of several forms and in FIGS. 1 and 2 the rotary second die 17 is shown as a ring die. The base 15 has a stationary cylindrical extension 19 coaxial with the first axis 18. Bearings 20 journal a rotary spindle 21 around this cylindrical extension 19. Arcuate segments 22 are secured by cap screws 23 and conical surfaces between the arcuate segments 22 and the rotary spindle 21 co-act to tightly secure the rotary ring second die 17 on the spindle 21. This permits ready replacement of the ring second die 17 for one of a different diameter or a different configuration.

Feed means 26 feeds workpieces 27 to an entrance end 28 of the stationary first die 16. Such die also has an exit end 29 for exit of the workpieces. The feed means 26 includes a reciprocating feed finger 30 to periodically feed workpieces to this entrance end 28 of the first die 16 so that the stems 31 of such workpieces will be engaged between the first and second dies for rotary passage of the stems of such workpieces between the dies in accordance with rotation of the second die 17.

The workpieces 27 are flanged stem workpieces having a flange 34. Such workpieces may be eyelets or spool valves with several flanges on a stem, or as shown in the drawing, may be poppet valves such as used in automotive engines. The flange 32 of the workpiece 27 is larger than the stem 31 and has a contact portion 34 of the flange 32 continually overlapping the rotary second die 17 so as to lie nominally in a first path 35 of a circular arc on a radius from the first axis 18.

The machine 14 includes a straightening member 38 journalled for rotation on the base. In FIGS. 1 and 2 this straightening member 38 is shown as a disc secured on a shaft 39 which is journalled inside the cylindrical extension 19 on the same first axis 18. At least one straightening roller 40 is provided on the straightening member 38. In FIGS. 1 and 2 four such straightening rollers are provided. Each straightening roller 40 is journalled in a block 41 fixed near the periphery of the disc 38 at equi-spaced intervals. Each straightening roller is journalled for free rotation on an axis 42 at an acute angle to the first axis 18. This journalling axis is dependent upon the type of flanged workpiece. The underside of such flange may have a contact portion 34 which is at a 30 degree angle to the horizontal and in such case the roller axis 42 would be at such 30 degree angle to properly cooperate with the flange 32. This provides a form of orbiting movement to the straightening roller 40 upon rotation of the die 17.

Movement means 45 is provided for the machine 14. This includes a motor 46 driving a bevel pinion 47, in turn driving a bevel gear 48 secured to the rotary spindle 21 to drive the rotary second die 17. A bevel pinion 49 is driven from the bevel gear 48 to drive a shaft 50 horizontally mounted in the machine 14. Another shaft 51 is disposed parallel to shaft 50 and the shafts are interconnected by change gears 52, 53. The shaft 51 is connected through bevel gears 54, 55 to the central shaft 39 to drive the straightening member 38. By this means the straightening rollers 40 are moved in a second path which intersects the first path 35. In the case of the machine of FIGS. 1 and 2 the first and second paths coincide. The feed means 26 is synchronized with the motion of the rotary second die 17. It may be operated by a bevel pinion, shafts and change gears similar to the linkage 49–53 and similar to that shown in U.S. Pat. No. 3,733,867 issued May 22, 1973 which shows such synchronized feeding of workpieces.

The change gears 52–53 may be selected so that the straightening member 38 rotates at exactly one-half the rotational speed of the rotary second die 17.

OPERATION

The stem 31 of each workpiece moves by planetary action between the first and second dies 16 and 17. The planetary movement of the workpiece establishes the workpiece movement at not quite one-half the periphal speed of the rotary die 17. The reason is that the radius to the first die working surface 56 is larger than the radius to the second die working surface 57. If one assumes a second die working surface 57 with a 6-inch radius and a workpiece stem with a diameter of 0.4 inches then this calculates to be that for a 180° arcuate movement of the second die 17, the workpiece 27 will have an arcuate movement of only about 84°. Accordingly, the feed means 26 establishes feed of a workpiece 27 to the entrance end 28 of die 16 just in advance of a straightening roller 40, assuming clockwise rotation of die 17 and straightening member 38. If the rotary die 17 rotates 180°, then the workpiece stem 31 will move a little less than 90°, about 84° in the above example, and straightening member 38 rotates 90°.

The straightening machine 14 also straightens the stems 31 of the workpieces 27. To accomplish this the first and second dies have ribs on the die working surfaces 56 and 57. Ribs 59 and 60 extend outwardly from the first die 16 and ribs 61 and 62 extend outwardly from the rotary second die 17. These ribs 59–62 are opposing cylindrical die surfaces and are offset in an axial direction with respect to each other. Accordingly, as the workpiece 27 moves in a planetary manner between the dies 16 and 17 the stem 31 is worked and progressiely bent along its length to straighten this stem. Preferably, progressively bending is a maximum at the midpoint of die 16 and decreases toward the exit end 29.

At the entrance end 28 of die 16, the workpiece 27 is in advance of the straightening roller 40. Since the straightening roller 40 moves 90° while the workpiece moves about 84° in the above example, the straightening roller contact area has a phase advancement movement to pass underneath the flange 32 and end up in advance of the flange 32 at the exit end 29 of the first die 16. In the midportion of the travel along the first die 16, the straightening roller 40 is directly under the flange 32 and deflects such flange a maximum extent. This would be similar to that shown in FIG. 4, as described below. The flange accordingly, is cyclically bent or, more properly, the material at the junction between the flange and the stem is bent so that the metal thereat is worked.

Automotive poppet type valves are currently made in three different ways. They may be forged or cast as a unitary piece, or they may be welded from two different metals used in the flange and the stem. Any of these three different methods of manufacture can produce valves which are warped and wherein the head or flange is not perpendicular to the stem. The present machine, by cyclically bending the head relative to the stem an increasing amount until the mid-portion of the die 16 is reached, and then a decreasing amount toward the exit end 29, will straighten such head.

FIG. 1 shows in phantom the position of a straightening roller 40A and this shows the position of such straightening roller relative to workpiece 27 if the ratio of the change gears 52 and 53 is changed. In the above example, die 17 has a speed of 2:1 relative to straightening member 38. Now if this ratio is changed, e.g., to 16:9, then the roller 40 may move to the position 40A by the time the workpiece 27 is at the exit end 29, as shown. This has the advantage of changing the arc through which the straightening of the flange takes place. Accordingly, by changing the gear ratio of the change gears 52, 53 this arc of straightening may be varied to suit different workpieces of different stem diameters and different flange diameters.

Figure 3:
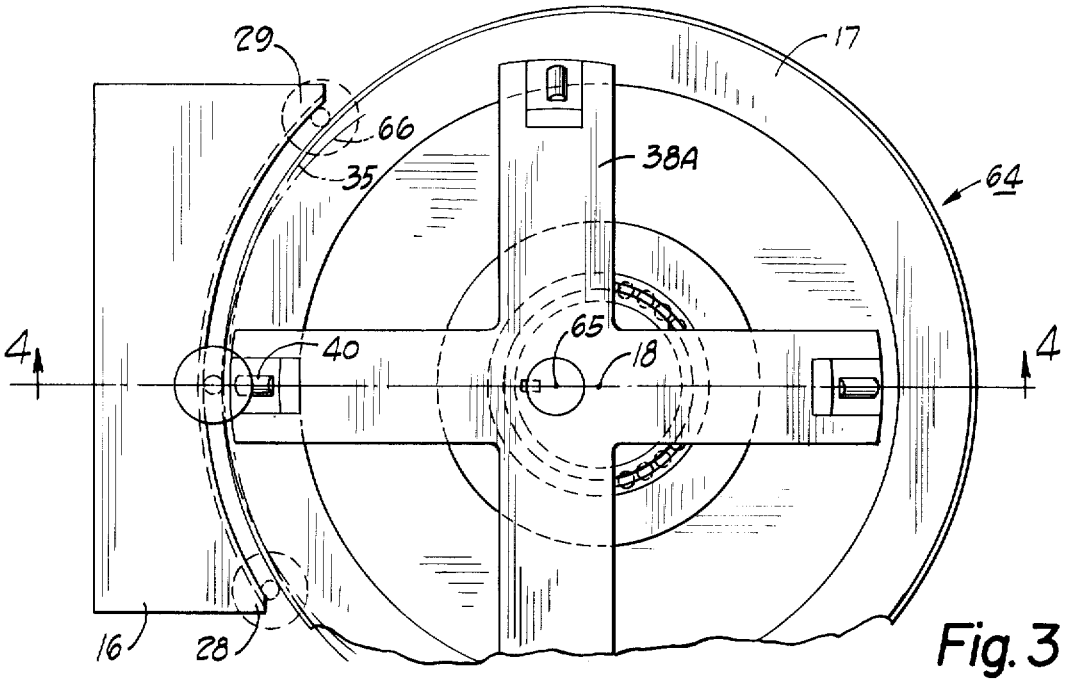
FIG. 3 is a partial plan view of a modification of the invention.
Figure 4:
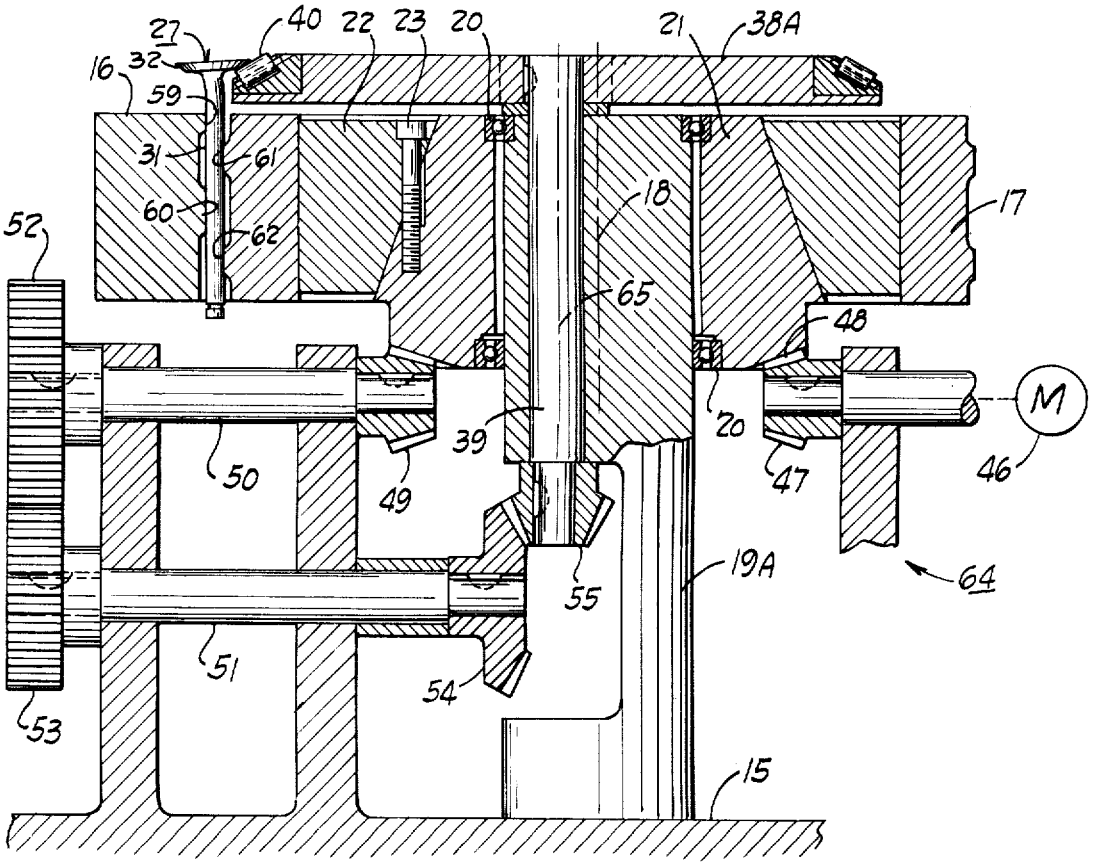
FIG. 4 is a sectional view on line 4—4 of FIG. 3.

FIGS. 3 and 4 illustrate a modification of the invention wherein a straightening machine 64 is similar in many respects to the machine 14 and like parts are provided with the same reference numerals. The base 15 has a stationary cylindrical extension 19A on which the ring die 17 is journalled. The straightening member 38A is shown in a cross form rather than as a disc, but still has a plurality of equally spaced straightening rollers 40 secured near the periphery or the ends of the arms of the cross. The rollers 40 are shown as four in number. This straightening member 38A is fixed on shaft 39 which is journalled in the cylindrical extension 19A about a second axis 65 which is parallel to but offset relative to the first axis 18. Axis 65 is close to axis 18 and along a line which intersects axis 18 and also substantially bisects the first die 16. The radius of the arms of the straightening member 38A is shorter than the radius of the second die 17. In this way the first path 35 of the contact portion 34 of the workpiece flange 32 is on a larger arc than a second path 66 of the contact area of the straightening rollers 40. Accordingly, the second path 66 intersects the first path 35 at two places. At the entrance end 28 of the first die 16 the straightening roller 40 will be out of engagement with the workpiece flange 32 but will engage this flange after perhaps 5° or 10° of movement. At the mid-point of the first die 16, generally as shown in FIG. 3, the straightening roller 40 will deflect the flange 32 to a maximum extent as best shown in FIG. 4. From there on toward the exit end 29 of the first die 16 the amount of bending deflection of flange 32 decreases. The roller 40 preferably does not engage the flange 32 during the last 5° to 20° of movement of the workpiece. Accordingly, the flange is cyclically bent at its junction with the stem to straighten such flange, namely, to be perpendicular to the stem. At the same time the stem itself is straightened by the opposing ribs 59–62, as described for FIGS. 1 and 2.

FIGS. 5 and 6 show a further modification of the invention in a straightening machine 74. Many parts are the same as in previous Figures and bear like reference numerals. The machine of FIGS. 5 and 6 is a coaxial machine as in FIGS. 1 and 2 with shaft 39 journalled on the first axis 18. The machine 74 has a straightening member 38B shown as a disc, again with plural rollers equi-spaced around the periphery. At least one such roller is used and the number need not be four. Each straightening roller 40 in its respective block 41 is mounted for radially sliding movements in a slot 75. FIG. 7 illustrates the construction of the block 41 with a cylindrical stud 76 on the lower surface thereof to be received in a slide 77. Slide 77 slides radially in the radial slot 75 and is held in such slot by a plate 78 secured by screws, not shown.

A disc cam 80 is fixed on the upper end of the cylindrical extension 19B. A cam follower roller 81 is journalled on the inner end of the slide 77 and cooperates with the edge of the disc cam 80. The cam 80 has a rise at 82 and a fall at 83 positioned so as to cause the slide 77 and block 41 to move radially outwardly near the entrance end 28 of the first die 16. The cam fall 83 permits the block 41 to move radially inwardly near the exit end 29 of the first die 16, under the urging of a spring 84. The cam 80 is thus a means to establish a second path 86 of movement of the contact area of the roller 40 which second path intersects the first path 35 at two points. By this means the valve head or flange 32 is cyclically bent to be straightened in a manner similar to that described above.

Figure 8:
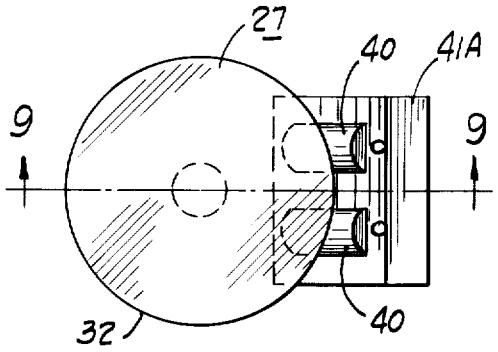
FIG. 8 is a plan view of a modified straightening roller block and a flanged stem workpiece.
Figure 9:
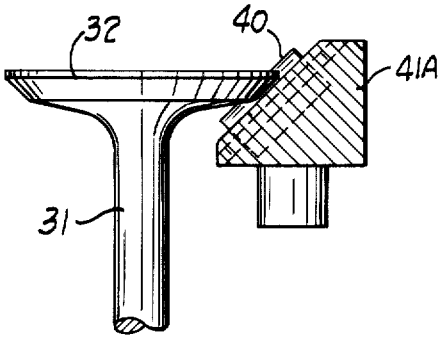
FIG. 9 is a sectional view on line 9—9 of FIG. 8.

FIGS. 8 and 9 illustrate a modified block 41A which journals two follower rollers 40 on spaced parallel axes. This modified block 41A may be used in the machines of FIGS. 3 and 4 or 5 and 6. By providing two straightening rollers 40, each with a contact area engaging the underside of the flange 32, a more positive control of the bending of such flange 32 is achieved. The bending force is balanced so that there is no tendency to tilt the axis of the workpiece stem 31.

Figure 10:
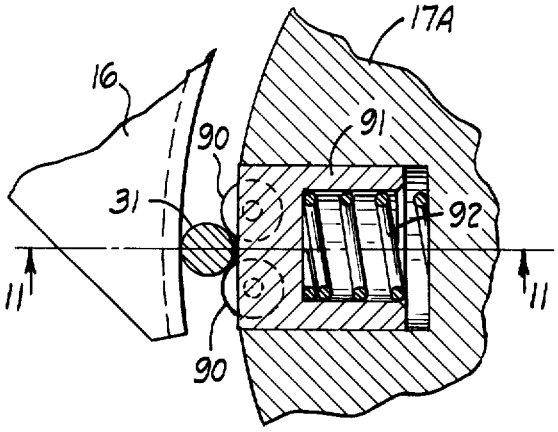
FIG. 10 is a partial plan view of straightening rollers for the stem of a workpiece.
Figure 11:
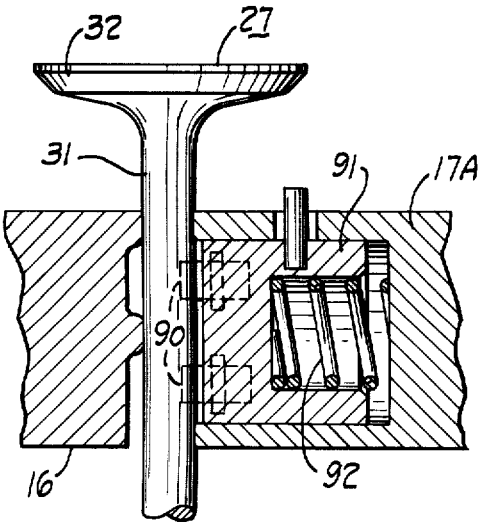
FIG. 11 is a sectional view on line 11—11 of FIG. 10.

FIGS. 10 and 11 show an alternative construction of a block 91 which journals two die rollers 90 on an upper level and two more die rollers 90 disposed at a roller level. As shown in FIG. 11, the upper and lower levels of die rollers take the place of the die ribs 61 and 62 on the rotary second die 17A. A strong spring 92 urges the die block 91 radially outwardly. The two die rollers 90 on the upper level will engage an upper portion of the workpiece stem 31 and the two die rollers 90 on the lower level will engage a lower area of the workpiece stem. By the use of the strong spring 92 straightening of the workpiece stem 31 may be accomplished the same as using the die ribs 61 and 62 in the embodiments of FIGS. 1–6.

The die rollers 90 will accomplish rotary passage of the workpiece stems between the first and second dies 16 and 17 although this will not be a planetary passage, instead such rotary passage will be at the peripheral speed of the rotary second die 17A. Such die rollers 90 have the advantage of positively locating the workpiece stem 31 to avoid any possibility of cocking or skewing of the workpiece stem so that it is not parallel to the first axis 18. This modification of FIGS. 10 and 11 may be used in any one of the straightening machines 14, 64 or 74, with the geared speed of straightening member 38 taking into account that the rotary passage is now approximately twice the former speed. This is an advantage of using the change gears 52, 53 so that such changed speed of the rotary passage of the workpiece may readily be accommodated.

The movement means 45 includes gearing interconnecting the rotary second die 17 and the straightening member 38 to establish a prescribed driven rotational speed of the straightening member.

The straightening rollers 40 are positioned closely adjacent the rotary second die 17 to engage the underside of the flange 32, namely, that side of the flange facing the rotary second die. Such rollers and straightening members may be positioned above the flange 32 to engage the upper surface thereof. In FIG. 2 the roller axis 42 is shown at about 30° angle relative to the horizontal and is shown at about a 45° angle in FIG. 9. Blocks with rollers at different angles may be readily interchanged to accommodate different angles of the contact portion 34 on the flange 32. The rollers 40 turn freely at the peripheral speed of the flange 32.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A straightening machine for a flanged stem workpiece, comprising in combination:

a base, an arcuate first die fixed on said base, a rotary second die journalled on said base on a first axis, feed means to feed workpieces to an entrance end of said first die for rotary passage of the stems of such workpieces between said first and second dies in accordance with rotation of said second die, the flange of the workpiece being larger than the stem thereof to have a contact portion of the flange continually overlapping said rotary second die to lie nominally in a first path of a circular arc on a radius from said first axis, a straightening member journalled for rotation on said base, a straightening roller connected for orbiting movement in accordance with rotation of said straightening member and with a contact area on the periphery of said roller, and movement means including rotation of said straightening member to establish movement of said roller contact area in a second path intersecting said first path during rotary passage of such workpiece stem between said dies to engage said flange and bend said workpiece cyclically with the amount of bending increasing and then decreasing thereafter toward the exit end of said first die to effect a straightening of such flange.

2. A straightening machine as set forth in claim 1, wherein said movement means includes drive means to establish a predeterminable rotational speed of said straightening member relative to said rotary second die.

3. A straightening machine as set forth in claim 1 wherein said straightening roller is positioned closely adjacent said rotary second die to engage the side of the workpiece flange facing said rotary second die.

4. A straightening machine as set forth in claim 1, including means journalling said straightening roller on said straightening member on an axis at an acute angle to said axis of rotation of said straightening member.

5. A straightening machine as set forth in claim 1, including opposing cylindrical die surfaces on said first and second dies with said die surfaces being offset in an axial direction with respect to each other to engage the stem of a workpiece therebetween for deflecting and straightening such stem during rotary passage between said dies.

6. A straightening machine as set forth in claim 1 wherein said movement means includes a gearing means interconnecting said rotary second die and said straightening member to establish a prescribed driven rotational speed of said straightening member.

7. A straightening machine as set forth in claim 6 including gearing said straightening member to have a speed one-half that of said rotary second die, said rotary passage of the stem of the workpiece being a planetary movement at slightly less than half the peripheral speed of said rotary second die to cause said straightening roller to gradually move past said flange.

8. A straightening machine as set forth in claim 7 including journalling said straightening member for rotation on said first axis.

9. A straightening machine as set forth in claim 1 including journalling said straightening member on said frame on a second axis closer to said first die than said first axis of said rotary second die to establish said second path on a smaller circular arc than said first path.

10. A straightening machine as set forth in claim 9 including journalling said straightening member on said second axis at a location to have said second path intersect said first path at two points.

11. A straightening machine as set forth in claim 9 including means establishing said second axis close to and parallel to said first axis and intersecting a line which substantially bisects said first die and also intersects said first axis.

12. A straightening machine as set forth in claim 1 wherein said movement means includes means to gradually change the phase position of said straightening roller relative to the contact portion of the workpiece flange.

13. A straightening machine as set forth in claim 1 wherein said movement means includes cam means to move said straightening roller relative to the workpiece.

14. A straightening machine as set forth in claim 13 including cam follower means cooperating with said cam means and connected to move said straightening roller.

15. A straightening machine as set forth in claim 14 wherein said cam means is stationary and said cam follower means is slidably journalled on said straightening member.

16. A straightening machine as set forth in claim 1 including two straightening rollers journalled closely together and each with a contact area to engage the same workpiece at spaced points.

17. A straightening machine as set forth in claim 16 wherein said straightening rollers are journalled on said straightening member.

18. A straightening machine as set forth in claim 16 wherein said straightening rollers are journalled on said rotary second die.

* * * * *